US008807875B2

(12) United States Patent
Shafer et al.

(10) Patent No.: US 8,807,875 B2
(45) Date of Patent: Aug. 19, 2014

(54) ICE WORTHY JACK-UP DRILLING UNIT WITH CONICAL PILED MONOPOD AND SOCKETS

(75) Inventors: Randall S. Shafer, Houston, TX (US); Peter G. Noble, Spring, TX (US); Ravi P. Aurora, Sugar Land, TX (US); Thomas E. Ramsey, Houston, TX (US); Ted H. Westerman, Sugar Land, TX (US); Dominique P. Berta, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 233 days.

(21) Appl. No.: 13/279,120

(22) Filed: Oct. 21, 2011

(65) Prior Publication Data

US 2012/0128435 A1 May 24, 2012

Related U.S. Application Data

(63) Continuation-in-part of application No. 13/277,791, filed on Oct. 20, 2011, and a continuation-in-part of application No. 13/277,755, filed on Oct. 20, 2011.

(60) Provisional application No. 61/405,497, filed on Oct. 21, 2010, provisional application No. 61/414,950, filed on Nov. 18, 2010.

(51) Int. Cl.

| | |
|---|---|
| ***E21B 17/08*** | (2006.01) |
| ***E21B 7/00*** | (2006.01) |
| ***E02B 17/02*** | (2006.01) |
| ***E21B 7/02*** | (2006.01) |
| *E02B 17/00* | (2006.01) |
| *B63B 35/08* | (2006.01) |

(52) U.S. Cl.

CPC ..... *E02B 17/0021* (2013.01); *E02B 2017/006* (2013.01); *E02B 17/027* (2013.01); *E21B 7/02* (2013.01); *E02B 2017/0039* (2013.01); *B63B 35/08* (2013.01); *E02B 2017/0082* (2013.01); *E21B 7/008* (2013.01); *E02B 2017/0069* (2013.01); *E02B 17/021* (2013.01)

USPC ..... 405/227; 405/196; 405/203; 405/211; 405/217

(58) Field of Classification Search

USPC ..... 405/196–199, 203, 211, 217, 224, 227

See application file for complete search history.

(56) References Cited

U.S. PATENT DOCUMENTS 3,716,994 A * 2/1973 Pogonowski ..... 405/204
3,751,930 A * 8/1973 Mott et al. ..... 405/196

(Continued)

FOREIGN PATENT DOCUMENTS

WO 9509280 4/1995
WO 2007126477 11/2007

OTHER PUBLICATIONS

PCT/US2011/057378 PCT International Search Report dated Jan. 30, 2012.

*Primary Examiner* — Tara M. Pinnock
(74) *Attorney, Agent, or Firm* — ConocoPhillips Company

(57) ABSTRACT

The invention relates to an ice worthy jack-up rig with a conical piled monopod working together to drill wells and produce hydrocarbons in ice prone locations. The inventive rig would work like a conventional jack-up rig while in open water with the hull jacked up out of the water. However, in the event of ice conditions, the legs are held in place by cans embedded in the sea floor to resist lateral movement of the rig and in sockets attached to the conical piled monopod. Both the hull and conical piled monopod are shaped with ice-bending surfaces to bend and break up ice that comes into contact.

14 Claims, 8 Drawing Sheets

(56) References Cited

U.S. PATENT DOCUMENTS

| | | | | | |
|---|---|---|---|---|---|
| 3,972,199 | A | | 8/1976 | Hudson et al. | |
| 4,102,144 | A | * | 7/1978 | Anders | 405/211 |
| 4,648,751 | A | * | 3/1987 | Coleman | 405/209 |
| 4,655,642 | A | * | 4/1987 | Birdy et al. | 405/217 |
| 4,666,343 | A | * | 5/1987 | Butt et al. | 405/217 |
| 4,762,442 | A | | 8/1988 | Thomas et al. | |
| 4,902,169 | A | * | 2/1990 | Sutton | 405/204 |
| 5,431,512 | A | | 7/1995 | Haney | |
| 5,447,391 | A | | 9/1995 | Gallaher et al. | |
| 5,741,089 | A | * | 4/1998 | Gallaher et al. | 405/196 |
| 5,855,455 | A | | 1/1999 | Williford et al. | |
| 2008/0237173 | A1 | * | 10/2008 | Altman et al. | 212/347 |

* cited by examiner

ICE WORTHY JACK-UP DRILLING UNIT WITH CONICAL PILED MONOPOD AND SOCKETS

CROSS-REFERENCE TO RELATED APPLICATIONS

This application is a non-provisional application which claims benefit under 35 USC §119(e) to U.S. Provisional Application Ser. No. 61/405,497 filed Oct. 21, 2010, entitled "Ice Worthy Jack-Up Drilling Unit," and to U.S. Provisional Application Ser. No. 61/414,950 filed Nov. 18, 2010, entitled "Conical Piled Monopod," and is a continuation-in-part application which claims benefit under 35 USC §120 to U.S. application Ser. No. 13/277,791 filed Oct. 20, 2011, entitled "Ice Worthy Jack-Up Drilling Unit" and to U.S. application Ser. No. 13/277,755 filed Oct. 20, 2011, entitled "Conical Piled Monopod", all four of which are incorporated herein in their entirety.

STATEMENT REGARDING FEDERALLY SPONSORED RESEARCH OR DEVELOPMENT

None.

FIELD OF THE INVENTION

This invention relates to mobile offshore drilling units, often called "jack-up" drilling units or rigs that are used in shallow water, typically less than 400 feet, for drilling for hydrocarbons.

BACKGROUND OF THE INVENTION

In the never-ending search for hydrocarbons, many oil and gas reservoirs have been discovered over the last one hundred and fifty years. Many technologies have been developed to find new reservoirs and resources and most areas of the world have been scoured looking for new discoveries. Few expect that any large, undiscovered resources remain to be found near populated areas and in places that would be easily accessed. Instead, new large reserves are being found in more challenging and difficult to reach areas.

One promising area is in the offshore Arctic. However, the Arctic is remote and cold where ice on the water creates considerable challenges for prospecting for and producing hydrocarbons. Over the years, it has generally been regarded that six unprofitable wells must be drilled for every profitable well. If this is actually true, one must hope that the unprofitable wells will not be expensive to drill. However, in the Arctic, little, if anything, is inexpensive.

Currently, in the shallow waters of cold weather places like the Arctic, a jack-up or mobile offshore drilling unit (MODU) can be used for about 45-90 days in the short, open-water summer season. Predicting when the drilling season starts and ends is a game of chance and many efforts are undertaken to determine when the jack-up may be safely towed to the drilling location and drilling may be started. Once started, there is considerable urgency to complete the well to avoid having to disconnect and retreat in the event of ice incursion before the well is complete. Even during the few weeks of open water, ice floes present a significant hazard to jack-up drilling rigs where the drilling rig is on location and legs of the jack-up drilling rig are exposed and quite vulnerable to damage.

Jack-up rigs are mobile, self-elevating, offshore drilling and workover platforms equipped with legs that are arranged to be lowered to the sea floor and then to lift the hull out of the water. Jack-up rigs typically include the drilling and/or workover equipment, leg-jacking system, crew quarters, loading and unloading facilities, storage areas for bulk and liquid materials, helicopter landing deck and other related facilities and equipment.

A jack-up rig is designed to be towed to the drilling site and jacked-up out of the water so that the wave action of the sea only impacts the legs which have a fairly small cross section and thus allows the wave action to pass by without imparting significant movement to the jack-up rig. However, the legs of a jack-up provide little defense against ice floe collisions and an ice floe of any notable size is capable of causing structural damage to one or more legs and/or pushing the rig off location. If this type of event were to happen before the drilling operations were suspended and suitable secure and abandon had been completed, a hydrocarbon leak would possibly occur. Even a small risk of such a leak is completely unacceptable in the oil and gas industry, to the regulators and to the public.

Thus, once it is determined that a potentially profitable well has been drilled during this short season, a very large, gravity based production system, or similar structure may be brought in and set on the sea floor for the long process of drilling and producing the hydrocarbons. These gravity based structures are very large and very expensive, but are built to withstand the ice forces year around. Any opportunity to safely reduce development costs in the Arctic can save very substantial amounts of money.

BRIEF SUMMARY OF THE DISCLOSURE

The invention more particularly relates to a system including an ice worthy jack-up rig for drilling for hydrocarbons in potential ice conditions in offshore areas including a flotation hull having a relatively flat deck at the upper portion thereof. The flotation hull further includes an ice bending shape along the lower portion thereof and extending downwardly and inwardly around the periphery of the hull where the ice bending shape extends from an area of the hull near the level of the deck and extends downwardly near the bottom of the hull. An ice deflecting portion is arranged to extend around the perimeter of the bottom of the hull to direct ice around the hull and not under the hull. At least three legs are positioned within the perimeter of the bottom of the flotation hull wherein the legs are arranged to be lifted up off the seafloor so that the rig may be towed through shallow water and also extend to the sea floor and extend further to lift the hull partially or fully out of the water. A jack-up device is associated with each leg to both lift the leg from the sea bottom so that the ice worthy jack up rig may float by the buoyancy of the hull and push the legs down to the seafloor and push the hull partially up and out of the water when ice floes threaten the rig and fully out of the water when ice is not present. The system further includes a conical piled monopod having a body with a base at the bottom and a top deck at the top wherein the base is attached to pilings that are driven into the seafloor when the conical piled monopod structure is installed for use. The body of the conical pile monopod includes an inclined ice engaging surface around the body extending from a wider lower region to a narrower upper region where the lower region is below the sea surface and the upper region is above the sea surface. The conical piled monopod further includes tabs with sockets arranged to receive a foot on at least one of the legs to be attached and held in place for drilling through the conical piled monopod. The rig is arranged to work with the conical piled monopod by lifting its hull out of the water and extend over the conical piled monopod to drill down through the conical piled monopod, lower itself into the water to assume an ice defensive position such that ice would contact the ice bending shape of the rig when thin ice is present, and be moved away when thick ice is present.

The invention further relates to a method for drilling wells in ice prone waters. The method includes providing a conical piled monopod having a body with a base at the bottom and a top deck at the top and an inclined ice engaging surface around the body extending from a wider lower region to a narrower upper region where the lower region is below the sea surface and the upper region is above the sea surface wherein the conical piled monopod includes at least one tab with a socket for receiving and holding a foot of a jack-up drilling rig. Pilings are driven into the seafloor and attaching the pilings to the conical piled monopod to fix the conical piled monopod to the sea floor. A rig is provided have flotation hull and a relatively flat deck at the upper portion thereof and an ice bending shape along the lower portion thereof where the ice bending shape extends from an area of the hull near the level of the deck and extends downwardly near the bottom of the hull. An ice deflecting portion is provided to extend around the perimeter of the bottom of the hull to direct ice around the hull and not under the hull. At least three legs are positioned within the perimeter of the bottom of the hull. Each leg is jacked down in a manner that at least one foot on the bottom of one of the legs engages the socket on the tab of the conical piled monopod and the remaining feet engage the sea floor or another socket on a tab and lifts the hull up and fully out of the water when ice is not threatening the rig while the rig is drilling a well on a drill site. The hull is further lowered into the water into an ice defensive configuration so that the ice bending shape extends above and below the sea surface to bend ice that comes against the rig to cause the ice to submerge under the water and endure bending forces that break the ice where the ice flows past the rig. A well is drilled from the rig over the side of the deck and down through the conical piled monopod.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
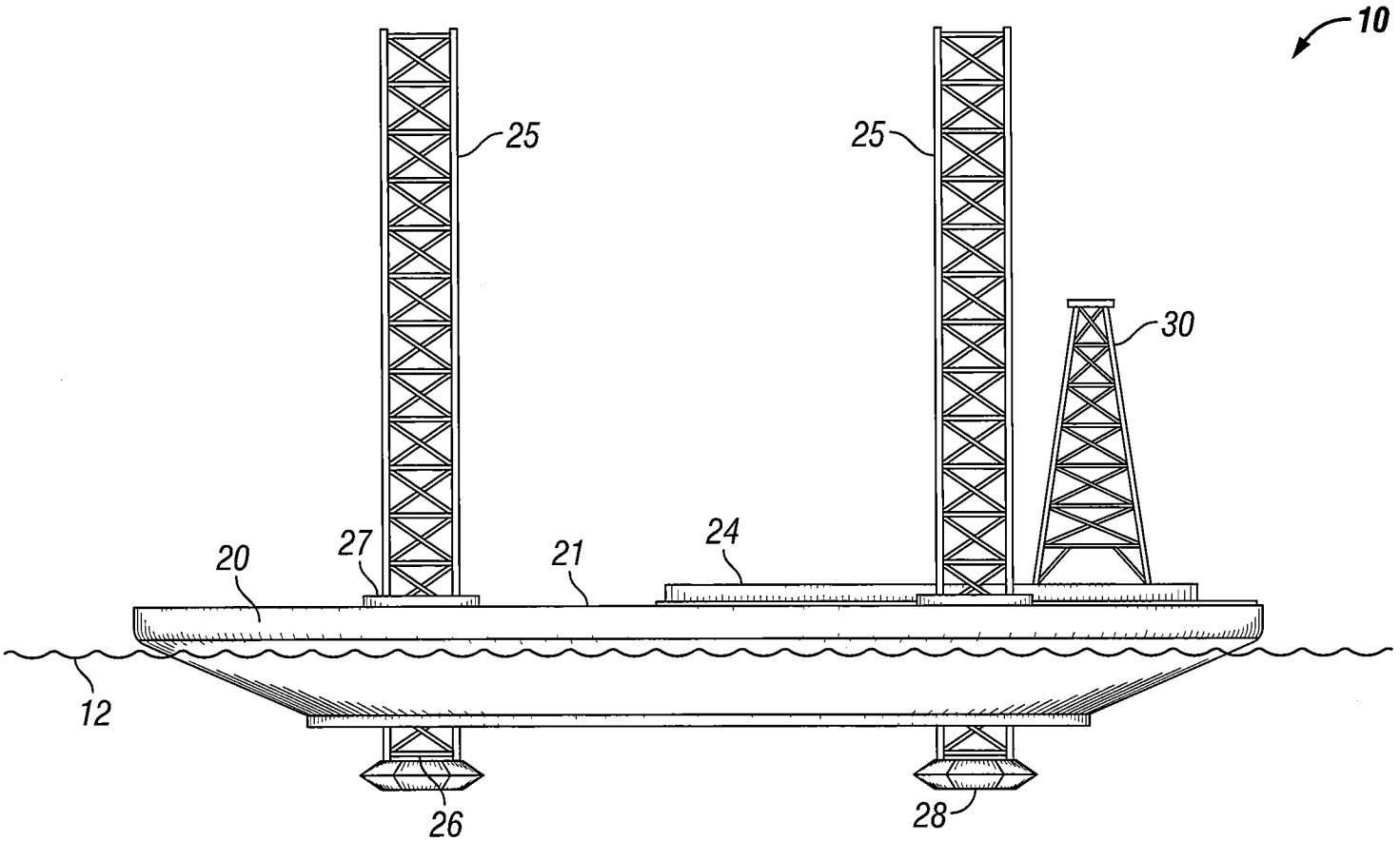
FIG. 1 is an elevation view of the present invention where the drilling rig is floating in the water and available to be towed to a well drilling site.

As shown in FIG. 1, an ice worthy jack-up rig is generally indicated by the arrow 10. In FIG. 1, jack-up rig 10 is shown with its hull 20 floating in the sea and legs 25 in a lifted arrangement where much of the length of the legs 25 extend above the deck 21 of the hull 20. On the deck 21 is derrick 30 mounted to drilling cantilever 24 and with other conventional equipment and systems, facilitate the drill of wells. In the configuration shown in FIG. 1, the jack-up rig 10 may be towed from one drilling site to another and to and from shore bases for maintenance and other shore service.

Figure 2:
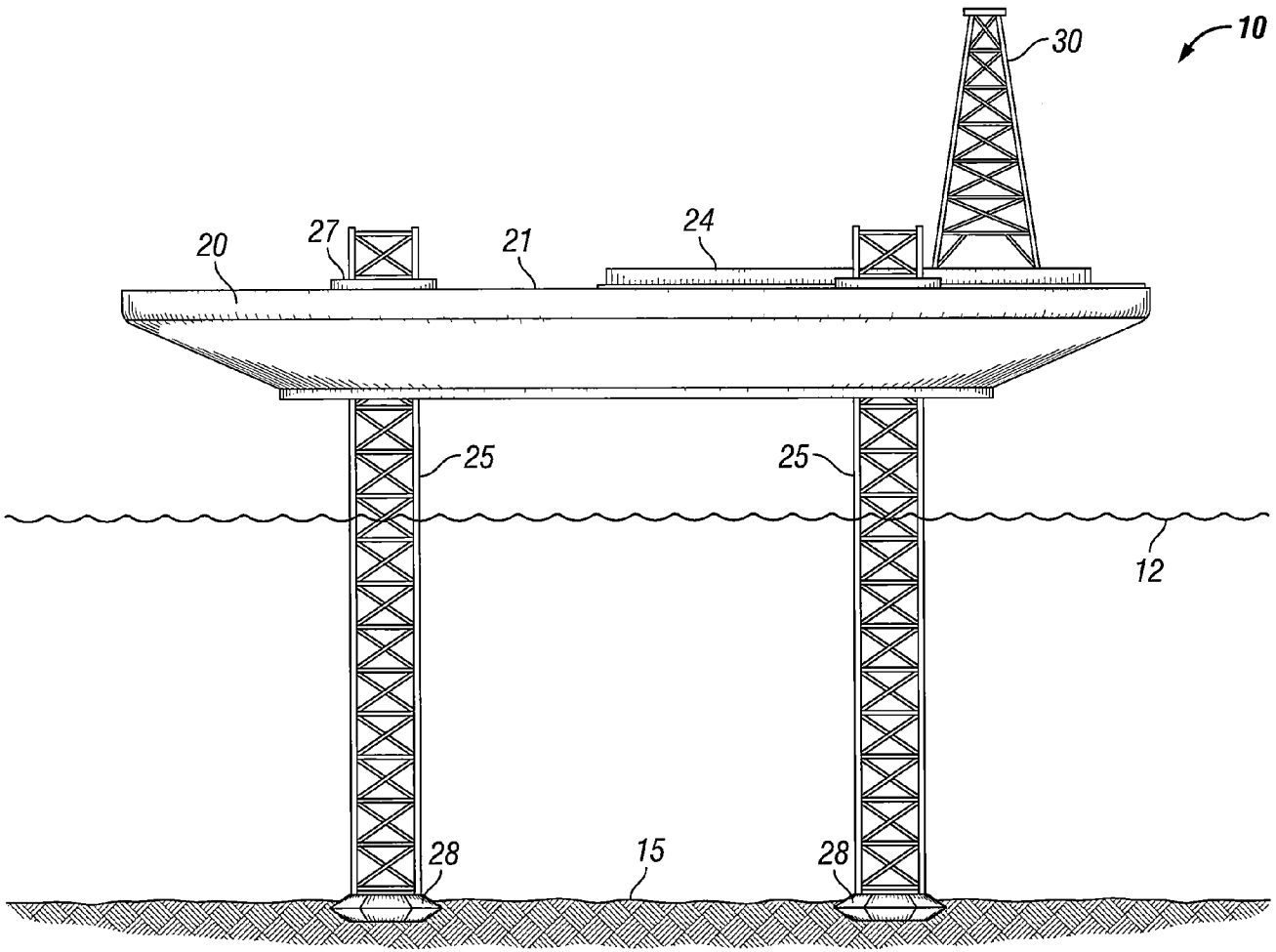
FIG. 2 is an elevation view of the present invention where the drilling rig is jacked up out of the water.

When the jack-up rig 10 is towed to a drilling site in generally shallow water, the legs 25 are lowered through the openings 27 in hull 20 until the feet 26 at the bottom ends of the legs 25 engage the seafloor 15 as shown in FIG. 2. In a preferred embodiment, the feet 26 are connected to spud cans 28 to secure the rig 10 to the seafloor. Once the feet 26 engage the seafloor 15, jacking rigs within openings 27 push the legs 25 down and therefore, the hull 20 is lifted out of the water. With the hull 20 fully jacked-up and out of the water, any wave action and heavy seas more easily break past the legs 25 as compared to the effect of waves against a large buoyant object like the hull 20.

Figure 3:
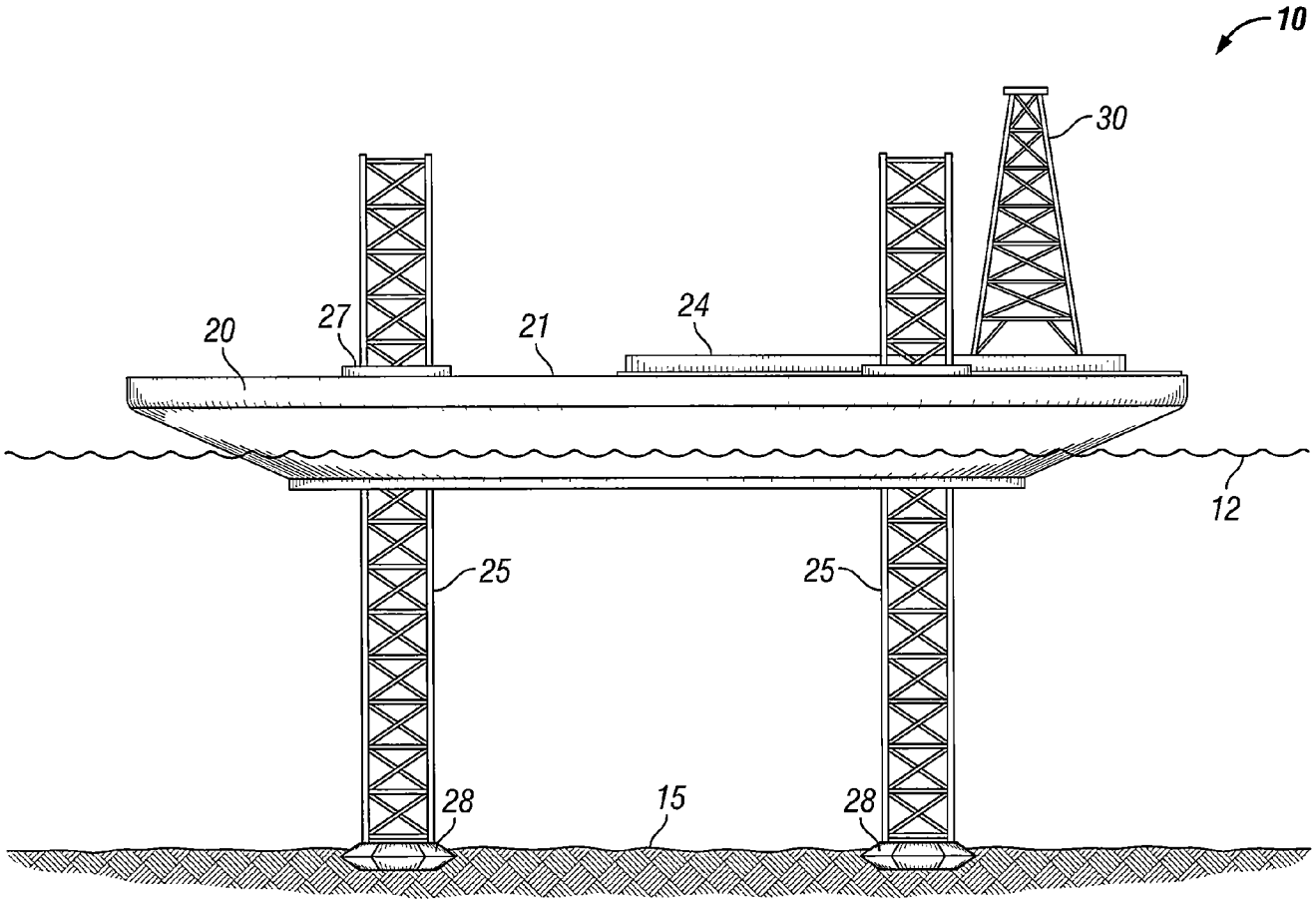
FIG. 3 is an elevation view of the first embodiment of the present invention where the drilling rig is partially lowered into the ice/water interface, but still supported by its legs, in a defensive configuration for drilling during potential ice conditions.

When ice begins to form on the sea surface 12, the risk of an ice floe contacting and damaging the legs 25 or simply bulldozing the jack-up rig 10 off the drilling site becomes a significant concern for conventional jack-up rigs and such rigs are typically removed from drill sites by the end of the open water season. The ice-worthy jack-up drilling rig 10 of the present invention is designed to resist ice floes by assuming an ice defensive, hull-in-water configuration as shown in FIG. 3. In FIG. 3, ice tends to dampen waves and rough seas, so the sea surface 12 appears less threatening, however, the hazards of the marine environment have only altered, and not lessened.

Figure 4:
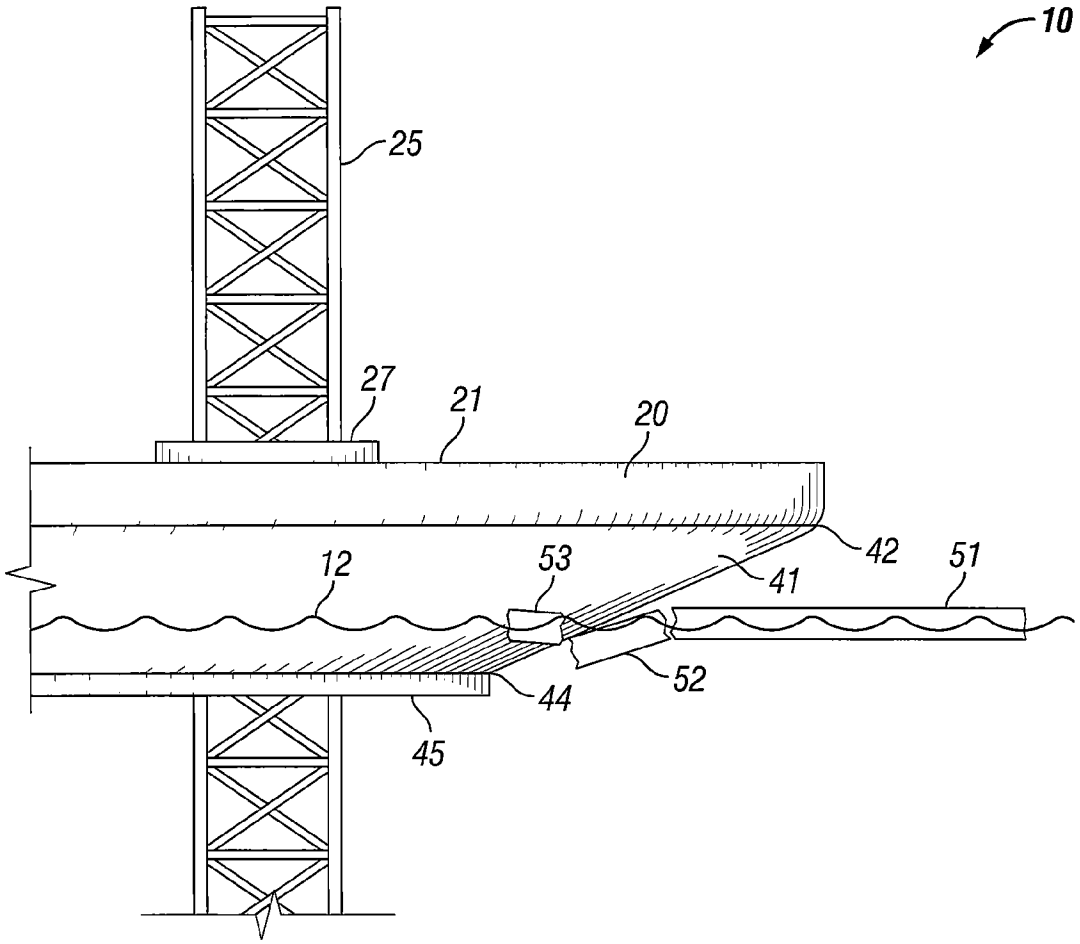
FIG. 4 is an enlarged fragmentary elevation view showing one end of the first embodiment of the present invention in the FIG. 3 configuration with ice moving against the rig.

When the ice-worthy jack-up rig 10 assumes its ice defensive, hull-in-water configuration, the hull 20 is lowered into the water to contact same, but not to the extent that the hull 20 would begin to float. A significant portion of the weight of the rig 10 preferably remains on the legs 25 to hold the position of the rig 10 on the drill site against any pressure an ice flow might bring. The rig 10 is lowered so that inwardly sloped, ice-bending surface 41, as best seen in FIG. 4 bridges the sea surface 12 to engage any floating ice that may come upon the rig 10.

The sloped ice-bending surface 41 runs from shoulder 42, which is at the edge of the deck 26, down to neckline 44. Ice deflector 45 extends downward from neckline 44. Thus, when an ice floe, such as shown at 51 comes to the rig 10, the ice-bending surface 41 causes the leading edge of the ice floe 51 to submerge under the sea surface 12 and apply a significant bending force that breaks large ice floes into smaller, less damaging, less hazardous bits of ice. For example, it is conceivable that an ice floe being hundreds of feet and maybe miles across could come toward the rig 10. If the ice floe is broken into bits that are less than twenty feet in the longest dimension, such bits are able to pass around the rig 10 with much less concern.

Figure 5:
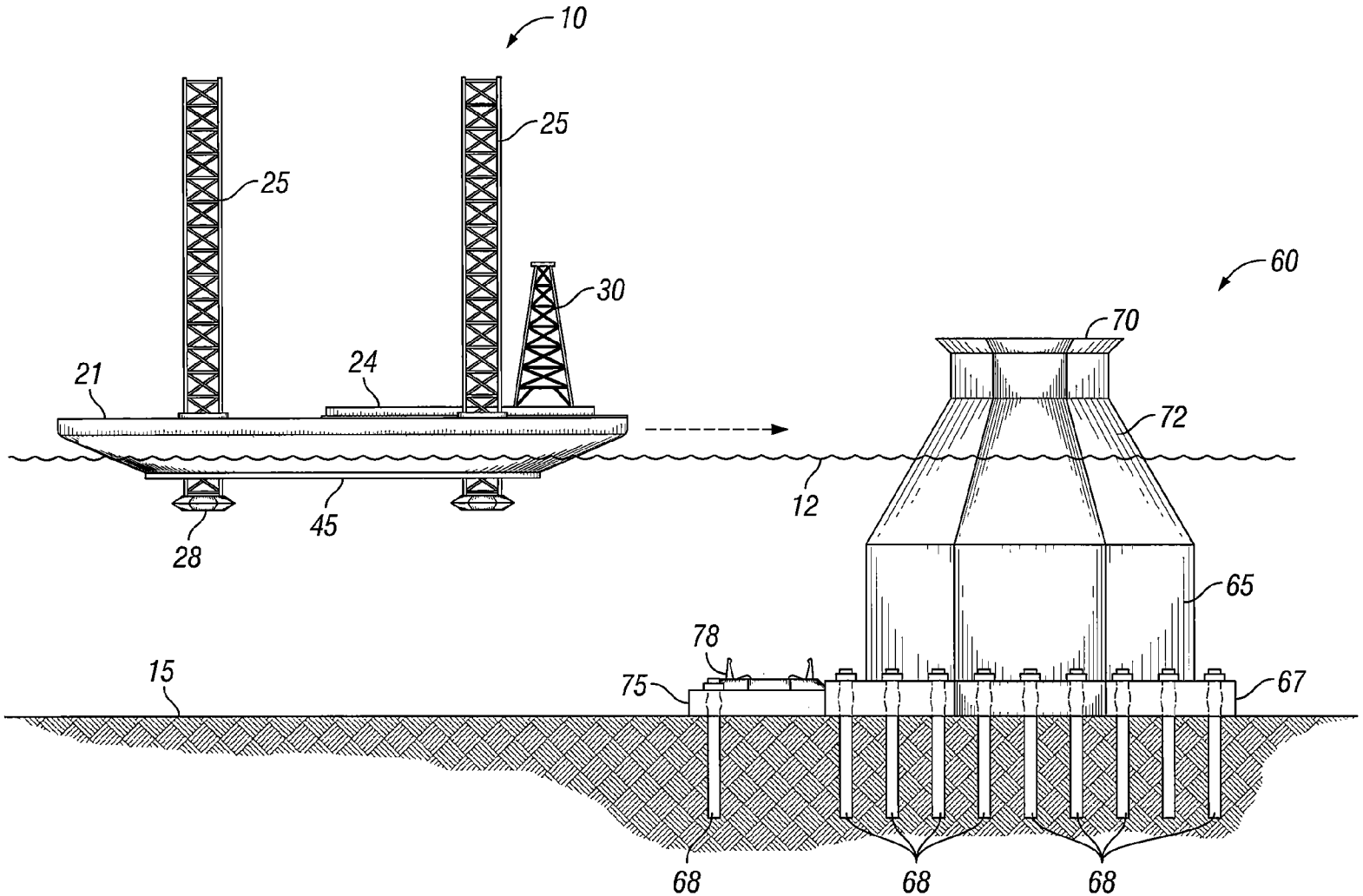
FIG. 5 is an elevation view showing the drilling rig moving to a conical piled monopod for drilling down through the conical piled monopod.

In FIG. 5, a conical piled monopod, generally indicated by the numeral 60, has been pre-installed to the seafloor. The conical piled monopod 60 is a structure that may be used in ice-prone, offshore locations at much lower cost as compared to a conventional gravity based structure (GBS). A conical piled monopod 60 includes a body 65, a base 67 and a top deck 70. The base 67 preferably has the form of a flange with holes or perforations spaced around the perimeter of the conical piled monopod 60. The base 67 is arranged to rest on the seafloor 15. While the conical piled monopod 60 rests on the seafloor, the weight of the conical piled monopod is preferably carried by a plurality of pilings 68 that are driven deep into the seafloor 15 and then attached to the conical piled monopod 60. It is typical to drive the pilings 68 between about 35 and about 75 meters into the seabed to permanently fix the conical piled monopod 60 in its offshore location. The pilings 68 are typically strong, but hollow tubes or pipe like structures that act like long nails and provide a very structurally efficient arrangement for a permanent platform for offshore hydrocarbon drilling and production operations. The pilings have a relatively large diameter of between 1 and 3 meters with a wall thickness of about 2 to 10 cm. One particular advantage of the present invention is that with the weight of the conical piled monopod 60 supported by the pilings 68, little or no seabed preparation is necessary prior to installation and to the extent there is any seabed preparation, it is principally to create a level seafloor to set the conical piled monopod 60 onto as the pilings 68 are installed. A seabed comprising soft, muddy materials is not likely to be excavated and replaced with firmer materials.

With the conical piled monopod 60 supported by the pilings 68, preparation of the seafloor for installation of the conical piled monopod 60 is minimal or none. Once the pilings 68 are driven into the seafloor and firmly attached to the base 67, the pilings 68 provide resistance to: (a) forces that cause structures to slide along the seafloor, (b) forces that cause structures to overturn such as forces acting several meters above the base of a structure; and (c) forces that cause vertical movement both upwardly and downwardly. The resistance to both upward and downward motion or movement is important in resisting toppling forces that may be imposed by ice. The pilings 68 at the front side of the conical piled monopod 60 resist lifting forces that ice may impose on the upstream side to resist toppling over while the pilings 68 at the far side or back side or downstream side of the conical piled monopod 60 resist downward motion that would allow the back side to roll deeper into the seafloor 15. Using such long pilings provides a structurally efficient base for year around operations in an ice prone offshore ice environment that must resist ice loads that can be quite substantial. The pilings act like nails that hold the platform in place and are structurally more efficient than in the case of a GBS where resistance to overturning is provided only by the size and weight of the structure.

The length and number of the pilings 68 will be dictated by the magnitude of the predicted vertical and lateral forces and by the strength of the soil layers into which the pilings are driven. Preferably, the pilings are strategically arranged around the periphery of the base 67 to provide resistance to sliding and toppling forces with maximum structural efficiency. The base may include at least eight and preferably at least 16 pilings, and up to as many as 64 pilings, around the periphery at a spacing that would maximize structural efficiency and create a pile cluster where the number of clusters work together to resist lateral forces and support the conical piled monopod 60. The pilings 68 typically extend between 35 and 75 meters into the seabed depending on predicted loads and the strength characteristics of the soil. The conical piled monopod 60 is shown as an eight sided faceted structure but a round or circular configuration may also be employed. It is preferred that the structure be faceted for ease of fabrication having six, eight, or even 12 sides, preferably all being equal in dimension and where the conical piled monopod 60 is symmetrical.

The body 65 of the conical piled monopod 60 includes a sloped, ice-engaging surface 72 that extends from below the sea surface 12 to above the sea surface 12 such that ice in the sea, particularly floating ice, engages the body 65 at the sloped, ice-engaging surface 72. The ice-engaging surface 72 extends around the periphery of the conical piled monopod 60 so that ice from any direction will come into contact with the body 65 at the ice-engaging surface 72. The slope of the ice-engaging surface 72 causes any sheet of ice to rise up the slope and bend to a point of breaking and is typically between 40 degrees and 60 degrees from the horizontal and more preferably about 55 degrees from the horizontal. Broken ice chunks, called rubble, will work their way around the body 65, driven by the sea current or wind. Above the ice-engaging surface 72 the conical piled monopod includes a shape to turn away ice that pushes all the way up ice-engaging surface 72. A deck 70 is at the top of the conical piled monopod 60 may be equipped with a drilling template for drilling many wells.

The conical piled monopod 60 is a substantial structure typically having a dimension of deck 70 being more than 75 meters across. While being large and strong, one advantage of a conical piled monopod over a gravity based structure is that it is generally lighter in weight or more particularly, density, prior to any water ballasting. Solid ballast material is generally not needed for a conical piled monopod. While a gravity based structure (GBS) typically has a density of from 0.21 tonnes/$m^3$ to 0.25 tonnes/$m^3$, a conical piled monopod may be constructed to be 0.20 tonnes/$m^3$ down to about 0.18 tonnes/$m^3$. Often, a GBS would need solid ballast to increase its weight to provide resistance to sliding and overturning. By using piles or a cluster of pilings 68, the conical piled monopod 60 may be designed to be in lighter weight. The lighter density of a conical piled monopod may also translate into lower fabrication and transportation cost, not including the lower installation cost due to the avoided site preparation costs for preparing the seafloor for a large GBS system and for the high density ballast material often added to a GBS.

While conical piled monopods 60 may be equipped with a derrick and systems for drilling wells, there is a cost savings if the wells can be drilled by a jack-up rig as the conical piled monopod may be sized somewhat smaller and of course having cost savings on size alone, not to mention the cost savings for all the drilling related equipment and systems. Drilling well through the conical piled monopod with an ice worthy drilling rig such as rig 10 provides additional cost savings in that the rig does not necessarily have to be towed away at the first sign of ice. More wells may be drilled per year with an ice worthy rig 10 that can stay on station longer into the fall when other drill rigs are long gone.

Figure 6:
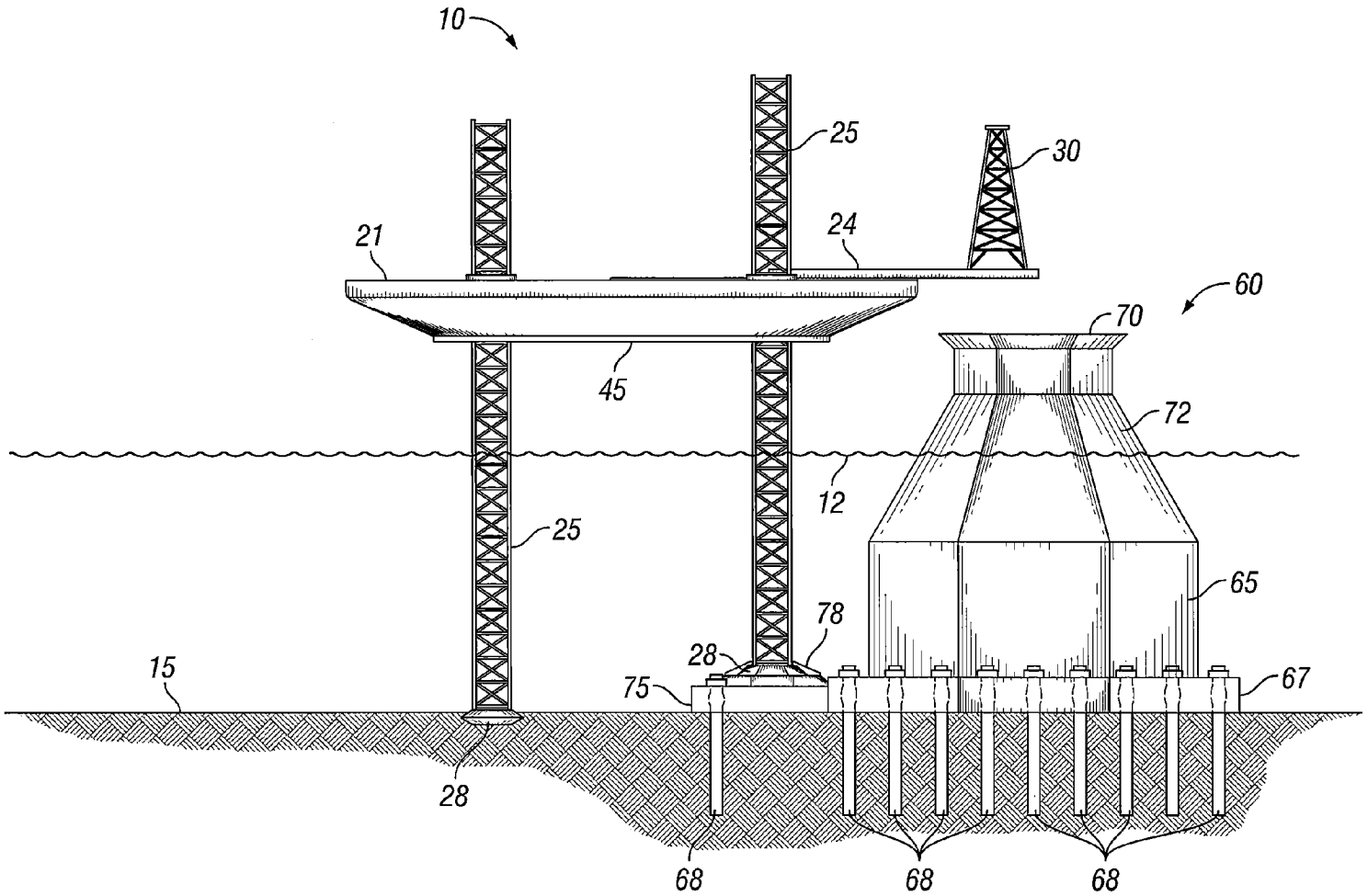
FIG. 6 is an elevation view showing the drilling rig arranged over the conical piled monopod to drill down through the conical piled monopod.

With the conical piled monopod 60 fixed to the sea floor 15, the drilling rig 10 moves in as shown in FIG. 5 and sets up to drill down through the conical piled monopod 60 as shown in FIG. 6. In one particular aspect of the present invention are tabs 75 extending out from base 67 that include pilings 68 to be secured to the seafloor 15. Spud cans 28 closest to the conical piled monopod 60 are aligned to set into sockets on the top of the tabs 75 and held in place by clasps 78. Thus, the rig 10 is provided additional resistance to movement by ice pressure by attaching to the conical piled monopod. This arrangement has been described as an "Ahab Socket" referring to the captain in Moby Dick inserting his peg leg into a knothole in the boat to stabilize himself while hunting whales.

Figure 7:
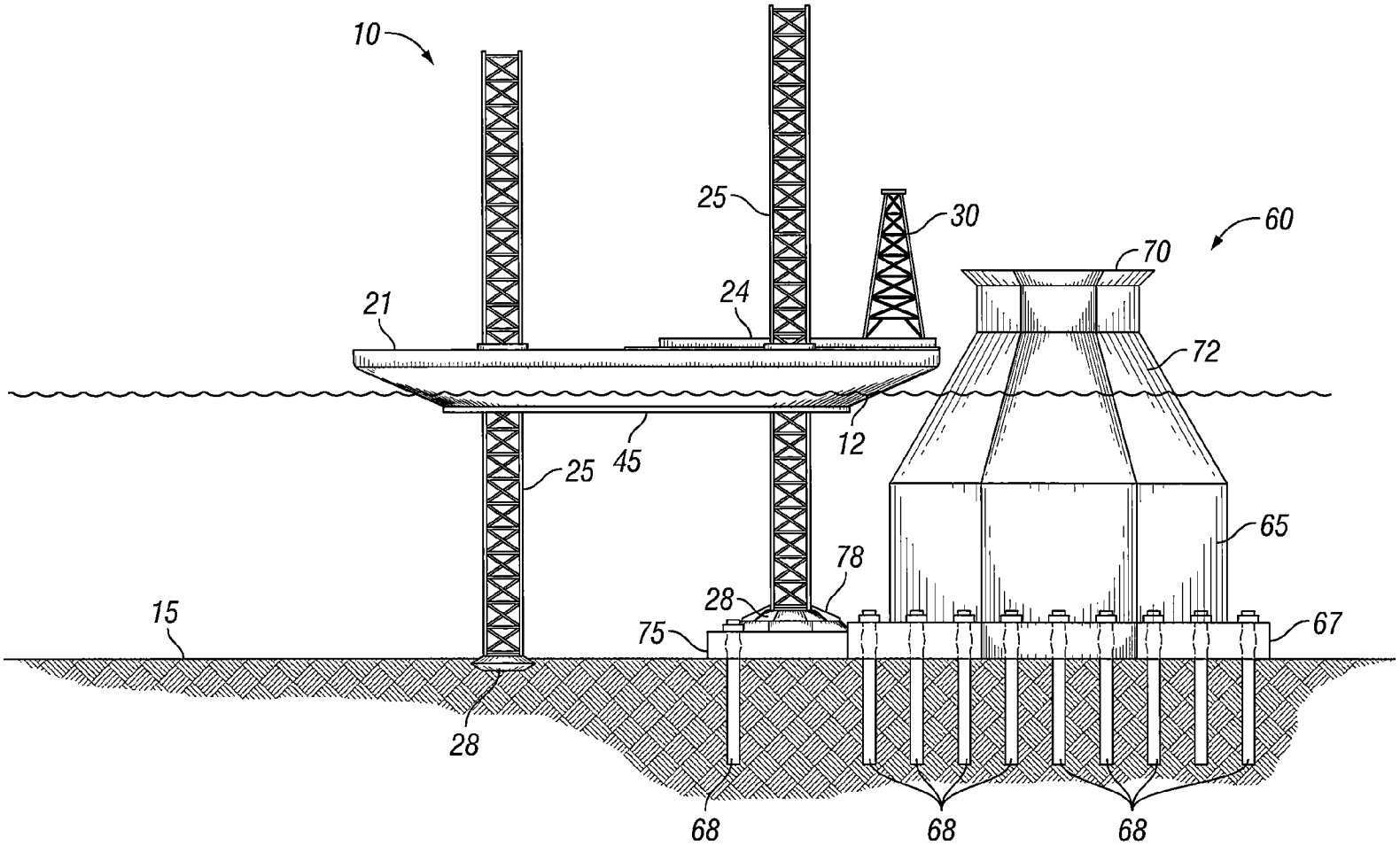
FIG. 7 is an elevation view showing the drilling rig arranged adjacent to the conical piled monopod in it ice defensive configuration.
Figure 8:
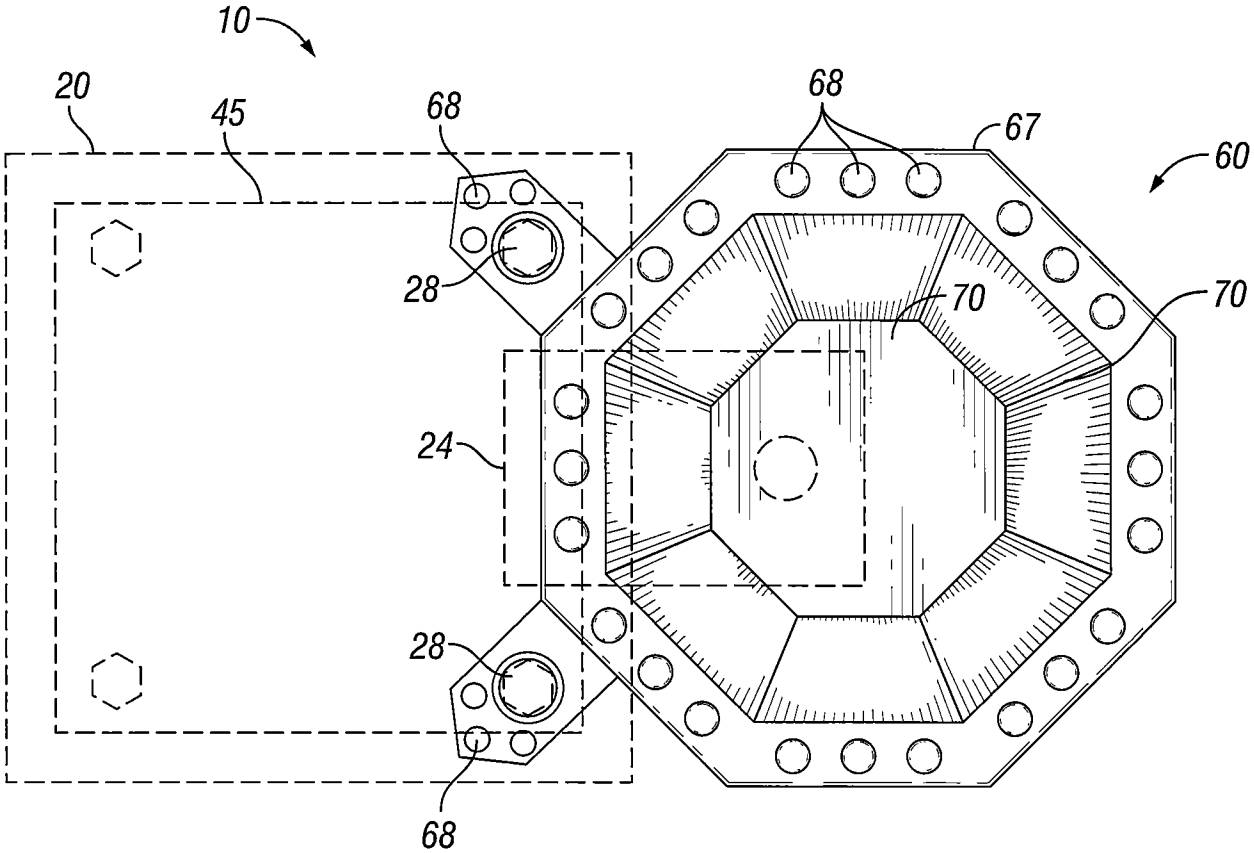
FIG. 8 is a top view showing the drilling rig positioned to drill down through the conical piled monopod.

Once secured into the sockets, the legs 25 of the ice-worthy drilling rig 10, which will be constructed stronger than conventional legs for jack-up rigs will be able to withstand limited ice threats. However, in the event that more significant ice threats present themselves, the ice-worthy drilling rig 10 has the option to stay on location, suspend drilling operations and assume an ice defensive configuration as shown in FIG. 7. In this position, ice that comes into contact with either or both of the rig 10 and conical piled monopod 60 will be broken up and directed to pass around the system. When the ice is abated, drilling may resume and when the ice becomes too thick, the rig 10 may be fully removed from the location until the following drilling season. It is the shape of the hull 20 (as well as its strength) that provides ice bending and breaking capabilities and expands the time window for drilling that substantially lowers costs for ice prone locations. While it is preferred that the rig 10 sets up adjacent one of the facets of the conical piled monopod as shown in FIG. 8, but may approach from any direction as indicated by 20A.

The hull 20 preferably has a faceted or multisided shape that provides the advantages of a circular or oval shape, and may be less expensive to construct. The plates that make up the hull would likely be formed of flat sheets and so that the entire structure comprises segments of flat material such as steel would likely require less complication. The ice-breaking surface would preferably extend at least about five meters above the water level, recognizing that water levels shift up and down with tides and storms and perhaps other influences. The height above the water level accommodates ice floes that are quite thick or having ridges that extend well above the sea surface 12, but since the height of the shoulder 42 is well above the sea surface 12, the tall ice floes will be forced down as they come into contact with the rig 10. At the same time, the deck 21 at the top of the hull 20 should be far enough above the water line so that waves are not able to wash across the deck. As such, the deck 25 is preferred to be at least 7 to 8 meters above the sea surface 12. Conversely, the neckline 42 is preferred to be at least 4 to 8 meters below the sea surface 12 to adequately bend the ice floes to break them up into more harmless bits. Thus, the hull 20 is preferably in the range of 5-16 meters in height from the flat of bottom to the deck 20, more preferably 8-16 meters or 11-16 meters.

It should also be noted that the legs 25 and the openings 27 through which they are connected to the hull 20 are within the perimeter of the ice deflector 45 so that the ice floes are less likely to contact the legs while the rig 10 is in its defensive ice condition configuration as shown in FIG. 3 and sometimes called hull-in-water configuration. Moreover, the rig 10 does not have to handle every ice floe threat to significantly add value to oil and gas companies. If rig 10 can extend the drilling season by as little as a month, that would be a fifty percent improvement in some ice prone areas and therefore provide a very real cost saving benefit to the industry.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

The invention claimed is:

1. A system for drilling and producing hydrocarbons in potential ice conditions in offshore areas comprising:

a rig having a flotation hull with a relatively flat deck at the upper portion thereof and an ice-bending shape along the lower portion thereof and extending downwardly and inwardly around the periphery of the hull where the ice-bending shape extends from an area of the hull near the level of the deck and extends downwardly near the bottom of the hull; an ice deflecting portion extending around the perimeter of the bottom of the hull to direct ice around the hull and not under the hull; at least three legs that are positioned within the perimeter of the bottom of the flotation hull wherein the legs are arranged to be lifted up off the seafloor so that the rig may be towed through shallow water and also extend to the sea floor and extend further to lift the hull partially or fully out of the water; and a jack-up device associated with each leg to both lift the leg from the sea bottom so that the ice worthy jack-up rig may float by the buoyancy of the hull and push the legs down to the seafloor and push the hull partially up and out of the water when ice floes threaten the rig and fully out of the water when ice is not present; and a conical piled monopod having a body with a base at the bottom and a top deck at the top wherein the base is attached to pilings that are driven into the seafloor when the conical piled monopod structure is installed for use, an inclined ice engaging surface around the body extending from a wider lower region to a narrower upper region where the lower region is below the sea surface and the upper region is above the sea surface and includes tabs with sockets arranged to receive a foot on at least one of the legs to be attached and held in place for drilling through the conical piled monopod;

wherein the rig is arranged to lift its hull out of the water and drill through the conical piled monopod, lower itself into the water to assume an ice defensive position such that ice would contact the ice-bending shape of the rig when ice is present, and be moved away when desired as the ice thickens.

2. The system according to claim 1, further including a clasp at the sockets that selectively holds a foot into the socket and, when desired, releases the foot.

3. The system according to claim 1, wherein the ice bending surface of the rig is slanted upwardly and outwardly from a smaller dimension neckline to a larger dimension shoulder.

4. The system according to claim 1, wherein the ice bending surface of the rig extends vertically at least 8 to 10 or more meters.

5. The system according to claim 4, wherein the angle of the ice-bending surface of the rig is in the range of 30 to 60 degrees from the vertical.

6. The system according to claim 1, wherein the body of the conical piled monopod is at least 60 meters across and the monopod structure has a density of less than about 0.20 tonnes/$m^3$.

7. The system according to claim 1, wherein the pilings are greater than or equal to 35 meters below the base.

8. The system according to claim 1, wherein the pilings are greater than or equal to 50 meters below the base.

9. A method for drilling a well in ice prone waters, the method comprising:

providing a conical piled monopod having a body with a base at the bottom and a top deck at the top and an inclined ice engaging surface around the body extending from a wider lower region to a narrower upper region where the lower region is below the sea surface and the upper region is above the sea surface wherein the conical piled monopod includes at least one tab with a socket for receiving and holding a foot of a jack-up drilling rig;

driving pilings into the seafloor and attaching the pilings to the conical piled monopod to fix the conical piled monopod to the sea floor, providing rig having a flotation hull having a relatively flat deck at the upper portion thereof and an ice-bending shape along the lower portion thereof where the ice-bending shape extends from an area of the hull near the level of the deck and extends downwardly near the bottom of the hull and an ice deflecting portion extending around the perimeter of the bottom of the hull to direct ice around the hull and not under the hull;

providing at least three legs that are positioned within the perimeter of the bottom of the hull;

jacking down each leg in a manner that at least one foot on the bottom of one of the legs engages the socket on the tab of the conical piled monopod and the remaining feet engage the sea floor or another socket on a tab such that the jacking down of the legs lifts the hull up and fully out of the water when ice is not threatening the rig while the rig is drilling a well on a drill site;

lowering the hull into the water into an ice defensive configuration so that the ice-bending shape extends above and below the sea surface to bend ice that comes against the rig to cause the ice to submerge under the water and endure bending forces that break the ice where the ice flows past the rig; and drilling a well over the side of the deck and down through the conical piled monopod.

10. The method according to claim 9 wherein the step of driving the pilings further comprises driving the pilings having at least a 1 meter diameter at least 35 meters into the sea floor.

11. The method according to claim 9 wherein the ice-bending surface extends from a shoulder to a neckline and the step of lowering the hull into the water more particularly comprises lowering the hull into the water so that the neckline is at least 4 meters below the sea surface and the shoulder is at least 7 meters above the sea surface.

12. The method according to claim 9 further including the step of raising the hull up out of the water when the threat of ice floes are reduced.

13. The method according to claim 9 wherein the step of driving the pilings further comprises driving the pilings having at least a 1.5 meter diameter at least 50 meters into the sea floor.

14. The method according to claim 9 wherein the step of driving the pilings further comprises driving the pilings having at least a 2 meter diameter at least 60 meters into the sea floor.

* * * * *